US012649989B2

(12) United States Patent
Watkins et al.

(10) Patent No.: US 12,649,989 B2
(45) Date of Patent: Jun. 9, 2026

(54) DEWATERING APPARATUS AND PROCESS

(71) Applicant: The Procter & Gamble Company, Cincinnati, OH (US)

(72) Inventors: Eric James Watkins, Lawrenceburg, IN (US); Victoria Grace Strain, Symmes Township, OH (US); Roger Scott Telvick, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 269 days.

(21) Appl. No.: 18/327,911

(22) Filed: Jun. 2, 2023

(65) Prior Publication Data

US 2024/0401271 A1 Dec. 5, 2024

(51) Int. Cl.
*D21F 1/76* (2006.01)
*D21F 1/48* (2006.01)

(52) U.S. Cl.
CPC ..... *D21F 1/483* (2013.01); *D21F 1/76* (2013.01)

(58) Field of Classification Search
CPC ..... D21F 1/489; D21F 1/76
USPC ..... 162/115
See application file for complete search history.

(56) References Cited

U.S. PATENT DOCUMENTS

| | | | | |
|---|---|---|---|---|
| 1,880,687 | A | 10/1932 | Berry | |
| 4,000,035 | A | 12/1976 | Schiel et al. | |
| 4,556,450 | A | 12/1985 | Chuang et al. | |
| 4,584,058 | A | 4/1986 | Lehtinen et al. | |
| 5,701,682 | A | 12/1997 | Chuang et al. | |
| 6,240,654 | B1 | 6/2001 | Weber et al. | |
| 6,746,573 | B2 | 6/2004 | Stelljes, Jr. et al. | |
| 7,527,709 | B2 | 5/2009 | Lippi et al. | |
| 7,550,061 | B2 | 6/2009 | Walkenhaus et al. | |
| 7,662,259 | B2 | 2/2010 | Hermans et al. | |
| 7,931,781 | B2 * | 4/2011 | Scherb | D21F 11/006 34/115 |

FOREIGN PATENT DOCUMENTS

| | | | |
|---|---|---|---|
| FR | 2011679 | A1 | 3/1970 |
| WO | 9641053 | A1 | 12/1996 |
| WO | 2011154598 | A1 | 12/2011 |

* cited by examiner

*Primary Examiner* — Jacob T Minskey
(74) *Attorney, Agent, or Firm* — Richard L. Alexander

(57) ABSTRACT

A capillary dewatering apparatus, including a framework with a plurality of apertures, and a flexible member disposed around an exterior surface of the framework, in which an inner surface of the flexible member is in contact with at least a portion of the exterior surface of the framework and in which the flexible member and the framework are not bonded. Also disclosed is a capillary dewatering process using the corresponding apparatus.

14 Claims, 4 Drawing Sheets

DEWATERING APPARATUS AND PROCESS

FIELD OF THE INVENTION

The present disclosure relates generally to apparatuses and processes for removing water from wet fibrous webs, and more particularly, to apparatuses and processes for removing water from a capillary cylinder utilized in dewatering fibrous webs in a papermaking process.

BACKGROUND OF THE INVENTION

In papermaking processes, a papermaking furnish may be formed into a wet fibrous web, and in turn, various devices may be used to remove water from the advancing fibrous web. For example, some manufacturing configurations may include drying devices such as vacuum boxes, hot air dyers, capillary dewatering apparatuses, and Yankee dryers, such as disclosed in U.S. Pat. Nos. 3,301,746; 4,556,450; and 5,598,643.

Dewatering apparatuses are used to remove water from fibrous structures of the type made in "wet-laid" papermaking processes. For metal porous covers currently used in these apparatuses, if the holes are made smaller to enable higher vacuum pressure and more dewatering, then the cover cannot be cleaned, and efficiency drops. Use of a vacuum is desired because it reduces the amount of water that must be evaporated downstream using hot air from burning natural gas. Further, the shape of the hole of metal porous cover is hypothesized to be a limiting factor to water removal efficiency. As such, there is a need for an improved dewatering apparatus that is easy to clean with improved efficiency, while using a vacuum.

SUMMARY OF THE INVENTION

In accordance with one aspect of the present disclosure, a capillary dewatering apparatus is provided, in which the dewatering apparatus may comprise a framework comprising a plurality of apertures, and a flexible member disposed around an exterior surface of the framework, wherein an inner surface of the flexible member is in contact with at least a portion of the exterior surface of the framework, and wherein the flexible member and the framework are not bonded.

In accordance with another aspect of the present disclosure, a dewatering apparatus is provided, in which the dewatering apparatus may comprise a rigid framework comprising a plurality of apertures, and a porous flexible member disposed such that an inner surface of the pourous flexible member is in contact with an exterior surface of the rigid framework, wherein a porosity of the porous flexible member is less than a porosity of the apertures in the rigid framework.

In accordance with another aspect of the present disclosure, a capillary dewatering process is provided, in which the process may comprise moving a wet web on a top side of a first belt, the first belt further comprising a bottom side; contacting the wet web with a top side of a flexible member, such that liquid flows from the wet web through a thickness of the flexible member; and contacting an exterior surface of a framework with a bottom side of the flexible member, such that the liquid flows from the flexible member to an interior portion of the framework. The flexible member may be porous. The framework may comprise a plurality of apertures. The flexible member may be configured to move independently of the framework.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
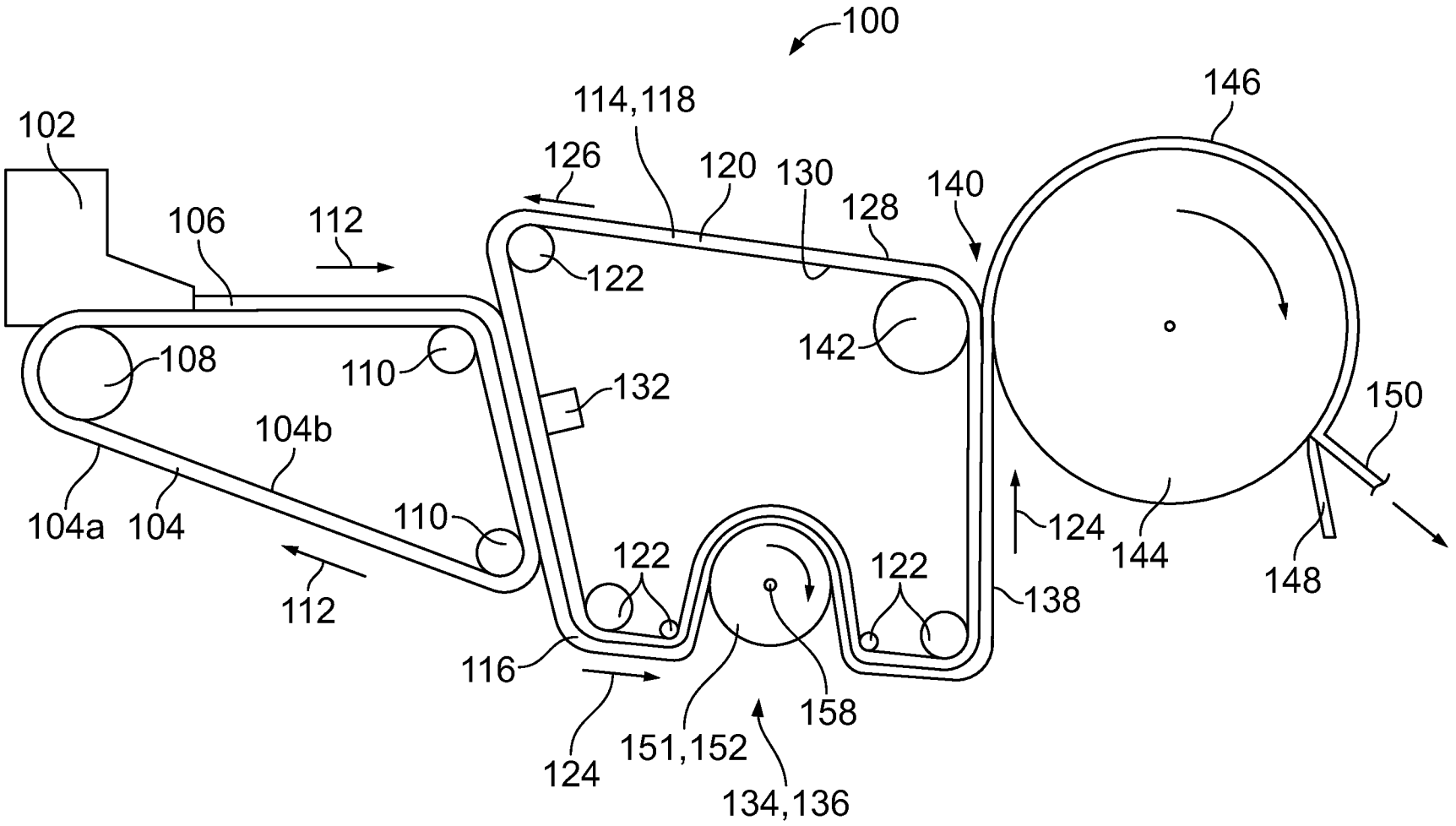
FIG. 1 is a schematic side view of an apparatus for producing fibrous structures, in accordance with the present disclosure.

As used herein, the use of the singular includes the plural and plural encompasses singular, unless specifically stated otherwise. In addition, in this application, the use of "or" means "and/or" unless specifically stated otherwise, even though "and/or" may be explicitly used in certain instances.

Fibrous structures such as paper towels, bath tissues, and facial tissues may be made in a "wet laying" process in which a slurry of fibers, usually wood pulp fibers, is deposited onto a forming wire and/or one or more papermaking belts such that an embryonic fibrous structure can be formed, after which drying and/or bonding the fibers together results in a fibrous structure. Further processing the fibrous structure can be carried out such that a finished fibrous structure can be formed. For example, in typical papermaking processes, the finished fibrous structure is the fibrous structure that is wound on the reel at the end of papermaking, and can subsequently be converted into a finished product (e.g., a sanitary tissue product) by ply-bonding and embossing, for example.

"Fibrous structure" as used herein means a structure that comprises a plurality of fibers. In one example, a fibrous structure according to the present disclosure means an orderly arrangement of fibers within a structure in order to perform a function. A bag of loose fibers is not a fibrous structure in accordance with the present disclosure. The terms "embryonic web," and "embryonic fibrous web" are used to describe a wet web that forms a fibrous structure after drying, i.e., a dry web. Further, fibrous structures may be rolled, interleaved, perforated, and/or packaged to form final product(s), such as a sanitary tissue product.

A "ply" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies," for example, by being folded on itself. A ply may comprise multiple layers. Multiple plies may, for example be formed as follows: fibrous structure of the present disclosure may be combined with one or more additional fibrous structures, which is the same or different from the fibrous structures of the present disclosure to form a multi-ply sanitary tissue product; said additional fibrous structure may be combined with the fibrous structure of the present disclosure by any suitable means.

"Sanitary tissue product" as used herein means a soft, low density (i.e., <about 0.25 g/cm$^3$) fibrous structure useful as a wiping implement for post-urinary and post-bowel movement cleaning (toilet tissue), for otorhinolaryngological discharges (facial tissue), and multi-functional absorbent and cleaning uses (absorbent towels and napkins). The sanitary tissue product may be convolutedly wound upon itself about a core or without a core to form a roll of sanitary tissue product. Further, the fibrous structure making up the sanitary tissue product may be perforated to form interconnected sheets.

The term "compressible" as used herein means with respect to an inner ring of a process roller that the inner ring is compressible in a radial direction, i.e., the inner ring's thickness $T_{IR}$ is compressible. For example, an outer surface of the inner ring may deform radially inwardly a greater extent than an inner surface of the inner ring such that the outer surface deforms radially inward toward the inner surface.

The term "deformable" as used herein means with respect to an outer ring of a process roller that the outer ring is deformable inwardly, i.e., both the inner and outer surfaces of the outer ring may deform inwardly together, so as to conform to the shape of an adjacent mating roller.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure.

The term "rigid" as used herein with respect to a framework means that a component holds its shape under the forces of its application in the papermaking process, i.e., it is not flexible like fabric.

The wet-laying process can be configured such that the finished fibrous structure has visually distinct features produced in the wet-laying process. Various forming wires and papermaking belts utilized can be configured to leave a physical, three-dimensional impression in the finished paper. Such three-dimensional impressions are known in the art, particularly in the art of "through air drying" (TAD) processes, with such impressions often being referred to a "knuckles" and "pillows." Knuckles may be regions formed in the finished fibrous structure corresponding to the "knuckles" of a papermaking belt, i.e., the filaments or resinous structures that are raised at a higher elevation than other portions of the belt. Likewise, "pillows" may be regions formed in the finished fibrous structure at the relatively lower elevation regions between or around knuckles.

Thus, in the description below, the term "knuckles" or "knuckle region," or the like can be used for either the raised portions of a papermaking belt or the corresponding portions formed in the paper made on the papermaking belt, and the meaning should be clear from the context of the description herein. Likewise "pillow" or "pillow region" or the like can be used for either the portion of the papermaking belt between, within, or around knuckles (also referred to in the art as "deflection conduits" or "pockets"), or the relatively lower elevation regions between, within, or around knuckles in the paper made on the papermaking belt, and the meaning should be clear from the context of the description herein. In general, knuckles or pillows can each be continuous, semi-continuous or discrete, as described herein.

Knuckles and pillows in paper towels and bath tissue can be visible to the retail consumer of such products. The knuckles and pillows can be imparted to a fibrous structure from a papermaking belt in various stages of production, i.e., at various consistencies and at various unit operations during the drying process, and the visual pattern generated by the pattern of knuckles and pillows can be designed for functional performance enhancement as well as to be visually appealing. Such patterns of knuckles and pillows can be made according to the methods and processes described in U.S. Pat. Nos. 4,514,345; 6,398,910; and 6,610,173, as well as U.S. Patent Publication No. 2016/0159007 A1; and U.S. Patent Publication No. 2013/0199741 A1 that describe belts that are representative of papermaking belts made with cured polymer on a woven reinforcing member. Fabric creped belts can also be utilized, such as disclosed in U.S. Pat. Nos. 7,494,563; 8,152,958; and 8,293,072. It is to be appreciated that some papermaking belts may comprise resin molding or resin deflection members, such as disclosed in U.S. Pat. No. 9,322,136, which is incorporated by reference herein. Additional descriptions of resins on papermaking belts are disclosed in U.S. Patent Publication Nos. 2017/0233951 A1; 2016/0090693 A1; 2016/0090692 A1; and 2016/0090698 A1, which are all incorporated by reference herein.

The present disclosure relates to methods for making fibrous webs, and in particular, to methods and apparatuses for removing water from a wet fibrous web during the manufacture of a fibrous structure. During the process of making a fibrous structure, various methods and apparatuses may be utilized to remove water from a wet porous web, such as a capillary dewatering apparatus. In some configurations, a capillary dewatering apparatus may include a capillary cylinder having an outer perimeter surface comprising a capillary porous media. A molding member, such as a papermaking belt comprising an air permeable fabric, may advance the wet fibrous web onto the rotating capillary cylinder. As such, the fibrous web is positioned between the capillary porous media and the air-permeable fabric. The capillary porous media comprises a first surface and a second surface positioned radially inward of the first surface, and water flows from the fibrous web through pores in the first surface and radially inward toward the second surface.

It is to be appreciated that various process and equipment configurations may be used to make fibrous structures. For example, FIG. 1 illustrates one example of an apparatus 100 for making fibrous structures according to the present disclosure. As shown in FIG. 1, an aqueous dispersion of fibers (a fibrous furnish) may be supplied to a headbox 102, which may be of any design known to those of skill in the art. From the headbox 102, the aqueous dispersion of fibers can be delivered to a foraminous member 104, which may be configured as a Fourdrinier wire or as a twin wire configuration, to produce an embryonic fibrous web 106. The foraminous member 104 may be supported by a breast roll 108 and a plurality of return rolls 110, of which only two are illustrated. The foraminous member 104 may be propelled in the direction indicated by directional arrows 112 by a drive means, not illustrated. Optional auxiliary units and/or devices commonly associated with fibrous structure making machines and with the foraminous member 104, but not illustrated, comprise forming boards, hydrofoils, vacuum boxes, tension rolls, support rolls, wire cleaning showers, and other various components known to those of skill in the art.

After the aqueous dispersion of fibers is deposited onto the foraminous member 104, the embryonic fibrous web 106 is formed, typically by the removal of a portion of the aqueous dispersing medium by techniques, such as for example, vacuum boxes, forming boards, hydrofoils, and other various equipment known to those of skill in the art. The embryonic fibrous web 106 may travel with the foraminous member 104 about return roll 110 and may be brought into contact with a molding member 114. The molding member 114 may comprise an air permeable fabric 118. The embryonic fibrous web 106 is transferred from the foraminous member 104 onto molding member 114. The transfer may be completed by any means known to those of skill in the art including, but not limited to, vacuum transfer, rush transfer, couch transfer, or combinations thereof. Various approaches to transfer may include those described in U.S. Pat. Nos. 4,440,597; 5,830,321; 6,733,634; 7,399,378; and 8,328,985. During the transfer onto the molding member 114, the embryonic fibrous web 106 may be deflected into deflection conduits or molded into the topology of the molding member 114. In addition, while in contact with the molding member 114, the embryonic fibrous web 106 can be further dewatered to form an intermediate fibrous web 116. The molding member 114 can be in the form of an endless belt 120, also referred to herein as a papermaking belt. In this simplified representation of FIG. 1, the molding member 114 passes around and about molding member return rolls 122 and impression nip roll 124 and may advance travel in the direction indicated by directional arrows 126. Cleaning means 174 for the molding member may be placed within the framework 151, 152 or may be at a separate location, as discussed below. Associated with the molding member 114, but not illustrated, can be various support rolls, other return rolls, drive means, and other various equipment known to those of skill in the art that may be used in fibrous structure making machines.

It is to be appreciated that the molding member 114 may be configured in various ways, such as an endless belt as just discussed or some other configuration, such as a stationary plate that may be used in making handsheets or a rotating drum that may be used with other types of continuous processes. As previously mentioned, the molding member 114 may comprise an air permeable fabric 118, and as such, the molding member 114 may be foraminous. As such, the forming member 114 may include continuous passages connecting a first surface 128 with a second surface 130. The first surface 128 (or "upper surface" or "working surface" or "outer surface") may be configured as the surface with which the embryonic fibrous web 106 is associated. And the second surface 130 (or "lower surface" or "inner surface") may be configured as the surface with which the molding member return rolls 122 are associated. Thus, the molding member 114 may be constructed in such a manner that when water is caused to be removed from the embryonic fibrous web 106 and/or intermediate fibrous web 116 in the direction of the molding member 114, such as by the application of differential fluid pressure such with a vacuum box 132, the water may be discharged from the apparatus 100 without having to again contact the embryonic fibrous web 106 in either a liquid state or vapor state.

As previously mentioned, various methods and apparatuses may be used to dry the intermediate fibrous web 116. Examples of such suitable drying process include subjecting the intermediate fibrous web 116 to conventional and/or flow-through dryers and/or Yankee dryers. In one example of a drying process, the intermediate fibrous web 116 in association with the molding member 114 passes around the molding member return rolls 122 and travels in the direction indicated by directional arrows 126. The intermediate fibrous web 116 may advance to a predryer section or system 134. The predryer system may 134 may include a conventional flow-through dryer (hot air dryer) and/or a capillary dewatering apparatus 136, such as shown in FIG. 1 and discussed in more detail below. Although the capillary dewatering apparatus 136 is described herein in the context of the predryer system 134 with the accompanying figures, it is to be appreciated that the capillary dewatering apparatus 136 herein may be utilized in various other configurations in a papermaking process. For example, the predryer system 134 may include a single roll or multiple separate rolls, such as a predryer system that includes a predryer roll and a separate capillary dewatering roll. In turn, a predried fibrous web 138, which may be associated with the molding member 114, advances from the predryer system 134 to a nip 140 between an impression nip roll 142 and a Yankee dryer 144. In some configurations, the predried fibrous web 138 advancing from the predryer system 134 may have a consistency of from about 30% to about 98%. A pattern formed by the first surface 128 of the molding member 114 may be impressed into the predried fibrous web 138 to form discrete elements (relatively high density) or, alternatively, a substantially continuous network (relatively high density) imprinted in a fibrous web 146. The imprinted fibrous web 146 may then be adhered to a surface of the Yankee dryer 144. The Yankee dryer may operate to dry the imprinted fibrous web to a consistency of at least about 95%. In some configurations, the drying process used to dry the intermediate fibrous web 116 may comprise through air dyers or pre-dryers without any Yankee dryer, which dry the web to a consistency of at least about 90% or at least about 95%. Such a process is described in U.S. Pat. No. 5,607,551, which is incorporated by reference herein.

With continued reference to FIG. 1, the imprinted fibrous web 146 may then be foreshortened by creping the web 146 with a creping blade 148 to remove the web 146 from the surface of the Yankee dryer 146, resulting in the production of a creped fibrous structure 150. In some operations, foreshortening may refer to the reduction in length of a dry (having a consistency of at least about 90% and/or at least about 95%) fibrous web, which occurs when energy is applied to the dry fibrous web in such a way that the length of the fibrous web is reduced and the fibers in the fibrous web are rearranged with an accompanying disruption of fiber-fiber bonds. The aforementioned method of foreshortening may be referred to as dry creping. It is to be appreciated that foreshortening may be accomplished in various additional ways, such as wet creping, wet microcontraction, and fabric creping. The creped fibrous structure 150 may also be subjected to post processing steps, such as calendaring, tuft generating operations, embossing, and/or converting.

As previously mentioned, the predryer system 134 may include a capillary dewatering apparatus 136. As shown in FIGS. 1 and 2, the capillary dewatering apparatus 136 may include a roll 151 (or "framework") that may be configured as a capillary cylinder 152 comprising a capillary porous media 154 including a first surface 156 and a second surface 158. The first surface 156 may define an outer perimeter surface (or "exterior surface") of the capillary cylinder 152, and the second surface 158 (or "interior surface") may be positioned radially inward of the first surface 156. The capillary porous media 154 includes pores adapted to receive and conduct liquid from first surface 156 radially inward toward the second surface 158. It is to be appreciated that the pores may be configured with various sizes. In some configurations, the pores may comprise effective diameters in the range of about 0.8 μm to about 10 μm. As used herein, the term "effective diameter" means that the pore acts, at least in the capillary sense, the same as a cylindrical pore of the stated diameter, albeit the pore of interest may have an irregular shape, i.e., not circular or cylindrical. The capillary cylinder 152 may also be adapted to rotate about an axis of rotation 160.

Figure 2A:
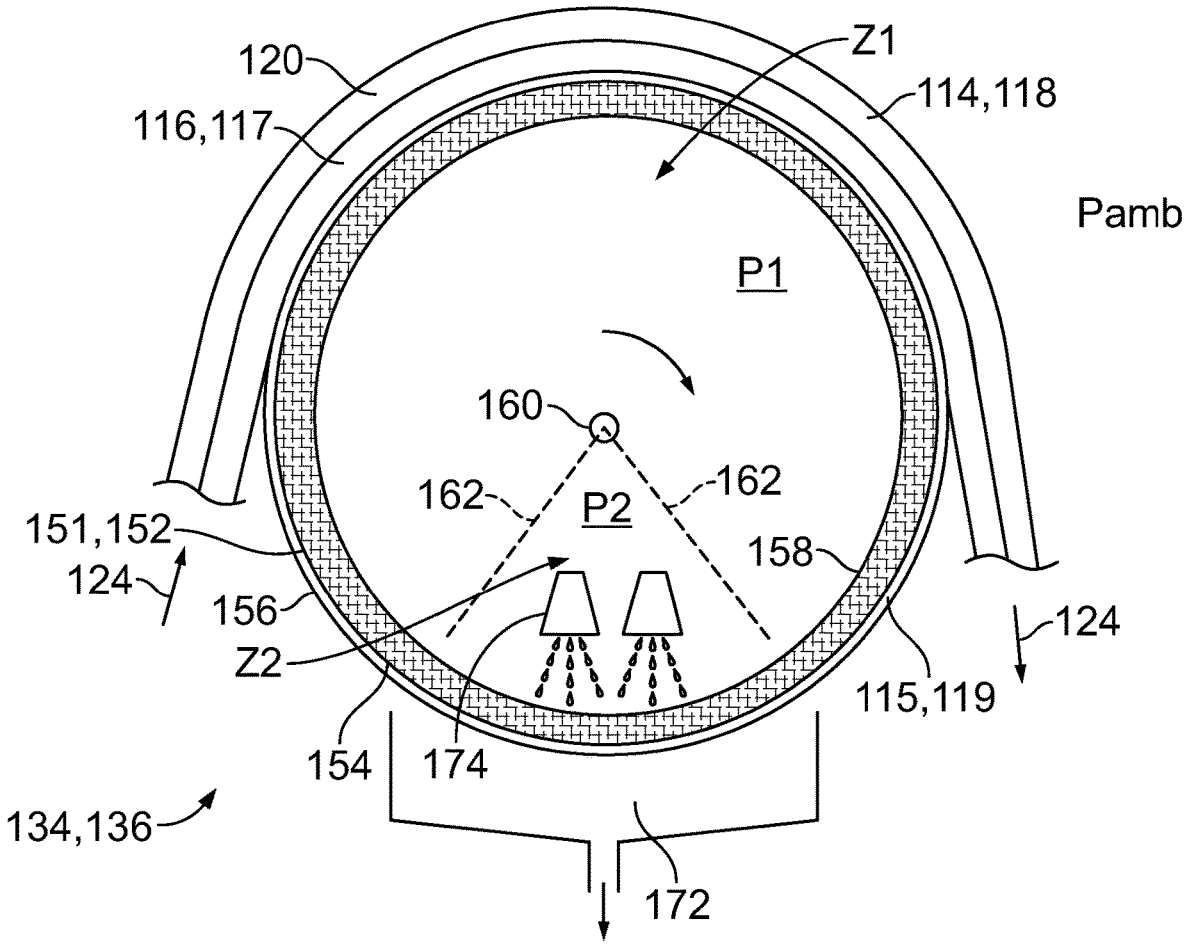
FIG. 2A is a detailed schematic side view of an exemplary capillary dewatering apparatus, in accordance with the present disclosure.

The inner radial volume of the capillary cylinder 152 may also be segmented into various zones, having different air pressures and wherein various different operations may be carried out. For example, as shown in FIG. 2A, the capillary cylinder 152 may include a first zone Z1 having a pressure P1 exerted on the second surface 158 and a second zone Z2 having a pressure P2 exerted on the second surface 158. In some configurations, a vacuum air system may be fluidly connected with the first zone Z1, such that pressure P1 is a vacuum pressure that is below an ambient pressure Pamb. A positive pressure air system may be fluidly connected with the second zone Z2, such that pressure P2 is a positive pressure that is above the ambient pressure Pamb. For the purposes of clarity, dashed lines 162 are shown in FIG. 2A to represent example boundaries between the first zone Z1 and the second zone Z2. It is to be appreciated that the capillary cylinder 152 and the capillary porous media 154 may be configured in various ways, such as disclosed for example, in U.S. Pat. Nos. 4,556,450 and 5,598,643, both of which are incorporated herein by reference. In aspects, the framework 151, 152 may be at least semi-rigid, and in particular aspects, the framework 151, 152 is rigid. In aspects, the framework 151, 152 may comprise a screen.

Figure 2B:
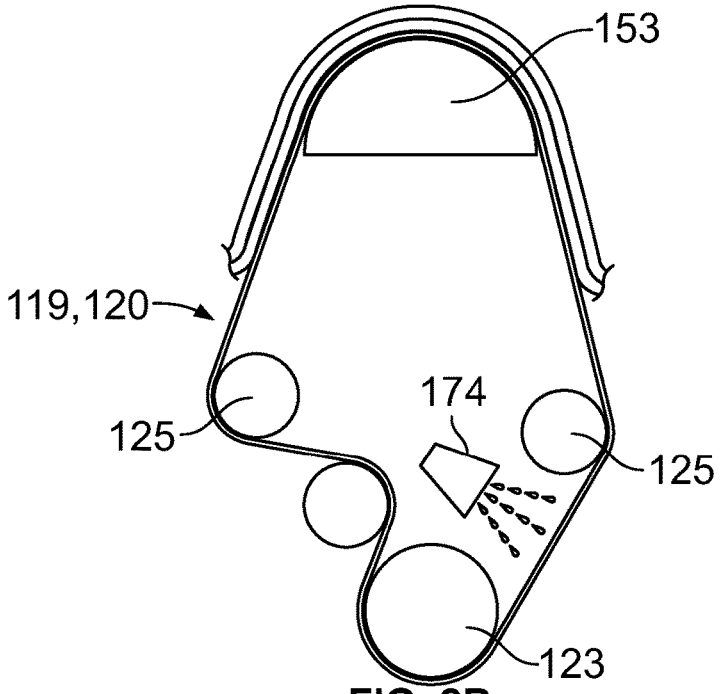
FIG. 2B is a schematic side view of another exemplary capillary dewatering apparatus, in accordance with the present disclosure.

The dewatering apparatus 136 may comprise a framework 151, 152 (e.g., a capillary cylinder) comprising a plurality of apertures or pores, and a flexible member 119 (also referred to herein as a porous flexible member) disposed around an exterior surface 156 (or "perimeter surface") of the framework 151, 152, in which an inner surface (not labeled in FIGS. 2A-2B; see FIGS. 4A and 4B) of the flexible member 119 is in contact with at least a portion of the exterior surface 156 of the framework 151, 152. The flexible member 119 and the framework 151, 152 are not bonded together. A flexible member 119 that is not bonded to the framework 151, 152 may be easier to clean than a structure that is bonded to the framework 151, 152. The dewatering apparatus 136 may be a capillary dewatering apparatus. In some examples, the flexible member 119 may be fitted over the exterior surface 156 of the framework 151, 152, such that the flexible member 119 forms a sock 115 over the framework 151, 152, as shown in FIG. 2A. In other examples, the flexible member 119 may be configured to rotate around the exterior surface 156 of the framework 151, 152, such that the flexible member 119 forms an endless belt 120, as shown in FIG. 2B. As shown in FIG. 2B, the framework 151 may comprise a rigid, stationary element 153 over which the endless belt 120 rides. The endless belt 120 is driven by a drive roll 123 and supported by one or more turning rolls 125.

In accordance with aspects of the present disclosure, a length of the flexible member 119 may exceed an outer perimeter of a contact surface of the framework 151, 152, in which the contact surface is defined by the exterior surface 156. In aspects, the length of the flexible member 119 may be at least two times larger than the outer perimeter of the contact surface of the framework 151, 152. In aspects, the length of the flexible member 119 may be at least five times larger than the outer perimeter of the contact surface of the framework 151, 152. In aspects, the length of the flexible member 119 is at least ten times larger than the outer perimeter of the contact surface of the framework 151, 152.

Figure 5:
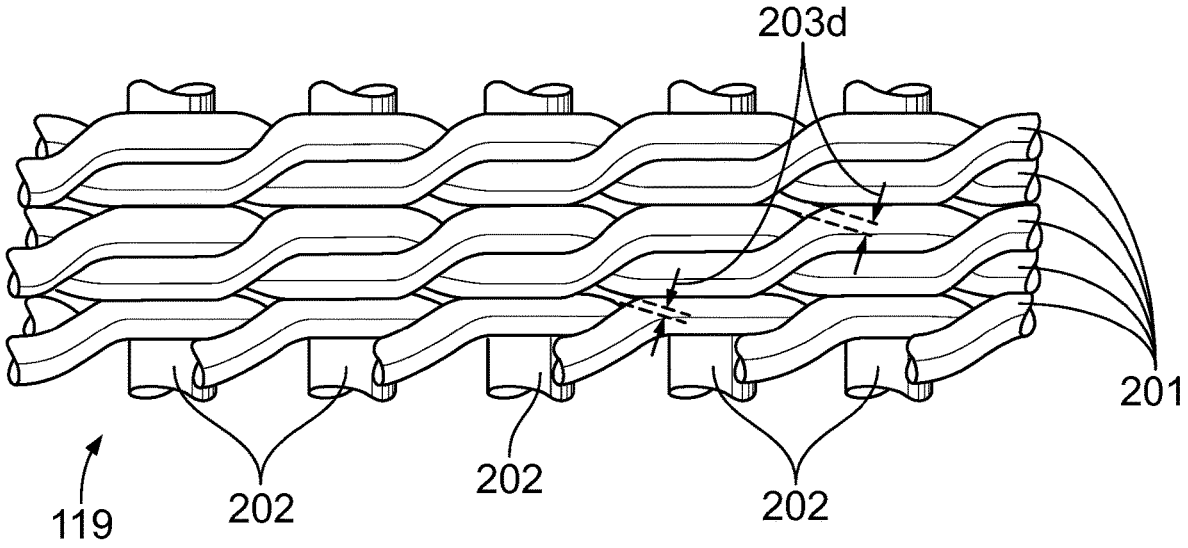
FIG. 5 depicts an exemplary woven flexible member.
Figure 6:
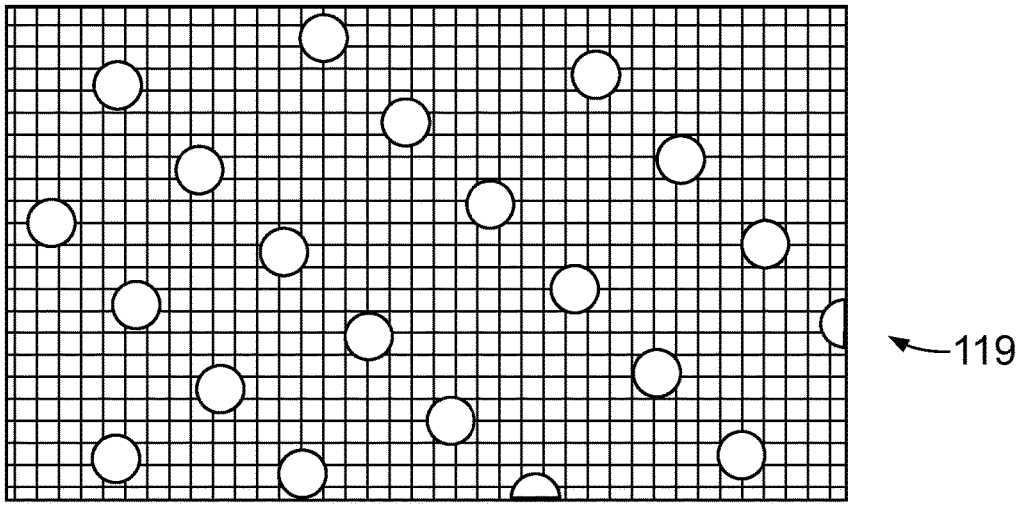
FIG. 6 depicts an exemplary flexible member comprising an apertured film.

In accordance with aspects of the present disclosure, the flexible member 119 comprise a variety of materials. In aspects, the flexible member 119 may be an apertured film, for example as shown in FIG. 6. In aspects, the flexible member 119 may be a woven flexible member in the form of a woven belt. A woven flexible member 119 may comprise plastic warps 202 and wefts 201, for example as shown in FIG. 5. FIG. 5 is an enlarged view of a portions of a woven flexible member 119, which is woven in what is generically called a Double Dutch Twill Weave. The warps 202 (i.e., the machine-direction filaments) of this weave may have substantially larger diameters than the diameters of the wefts 201 (i.e., cross-machine direction filaments). Thus, if the warps 202 and wefts 201 are of the same bendable material (as they preferably are), the wefts are easier to bend than the warps. Accordingly, as the wefts 201 are sequentially woven into place in the two-over, two-under, staggered pattern depicted in FIG. 5, the wefts 201 are crowded together into overlapping relation without substantially bending the warps 202. The weaving pattern of the warps 202 and the wefts 201 leaves spaces (i.e., pores) with pore diameters 203*d*. The effective pore diameter may be defined as the average of these pore diameters 203*d* throughout the woven flexible member 119. Such weaves commonly have weft counts that are up to about two times the theoretical weft count if such overlapping of the weft were not precipitated. Such woven fabrics have intricate, interconnected passageways or pores through them and can be woven with such fine filaments that the passageways/pores manifest preferential capillarity with respect to, for example, high-bulk tissue paper as described herein, albeit such pores are irregular in cross-section rather than being cylindrical or some other tubular shape having generally uniform cross-sections throughout their lengths. U.S. Pat. No. 3,327,866 which issued Jun. 27, 1967 to D. B. Pall et al discloses such woven fabrics, and their pore sizes as functions of "Warp Count," "Warp Diameter," "Shoot [Sic] Diameter," and "Shoot [Sic] Count," (shoots, as used in the '866 patent, are equivalent to wefts as used herein) as well as other parameters of such woven fabrics: particularly for use as filter media. It should be understood by a person of ordinary skill in the art that a variety of weaves may be used in the woven flexible member 119, as an alternative to the exemplary Double Dutch Twill Weave depicted in FIG. 5. In aspects, the pore shapes are different than the pore shapes achieved by the Double Dutch Twill Weave.

With reference to FIG. 2A, during operation, the molding member 114 advances the wet fibrous web 117 onto the rotating capillary cylinder 152, wherein the wet fibrous web 117 is positioned between the flexible member 119 and the air-permeable fabric 118 of the molding member 114. As the capillary cylinder 152 rotates, water or other liquids may be transferred from a wet fibrous web 117, such as the intermediate fibrous web 116 described above, through pores (not labeled in FIG. 2A; see FIG. 4) in the flexible member 119, and through pores in the first surface 156 of the capillary cylinder 152. The pneumatic pressure differential between the ambient pressure Pamb exerted on the wet fibrous web 117 and the vacuum pressure P1 from within the capillary cylinder 152 helps to push liquid from the fibrous web 117 into the pores in the flexible member 119 and the first surface 156 of the capillary porous media 154. The molding member 114 then advances the wet fibrous web 117 from the rotating capillary cylinder 152, and the pressurized air P2 may expel liquid from the pores that are no longer covered by the fibrous web 117. As shown in FIG. 2A, the liquid may be expelled from the capillary cylinder into a drain system 172 wherein the water can be reclaimed and/or reused. It is to be appreciated that various amounts of energy may be required to remove water from the fibrous web 117. For example, in some configurations, the energy required to remove 1 pound of water from the fibrous web 117 may be from about 1 BTU/lb to about 20 BTU/lb, specifically reciting all 1 BTU/lb increments within the above-recited range and all ranges formed therein or thereby.

While a vacuum 132 is useful in removing water from the fibrous web 117, if the vacuum pressure P1 is too high, it may cause punctures to form in the fibrous web 117, which is not desired. The pressure at which punctures are likely to form in the fibrous web is known as "breakthrough pressure." Improved capillary dewatering enables a lower vacuum pressure P1 to be applied, as more water is removed from the fibrous web 117 by the capillary dewatering process, thus avoiding use of a pressure near breakthrough pressure. Smaller effective pore diameters in the flexible member 119 increase the efficiency of water removal in capillary dewatering. However, conventional metal framework structures are difficult to clean if the pore diameters are too small, as these smaller pores are easily clogged and thus the water removal efficiency declines with the smaller pore.

Figure 4:
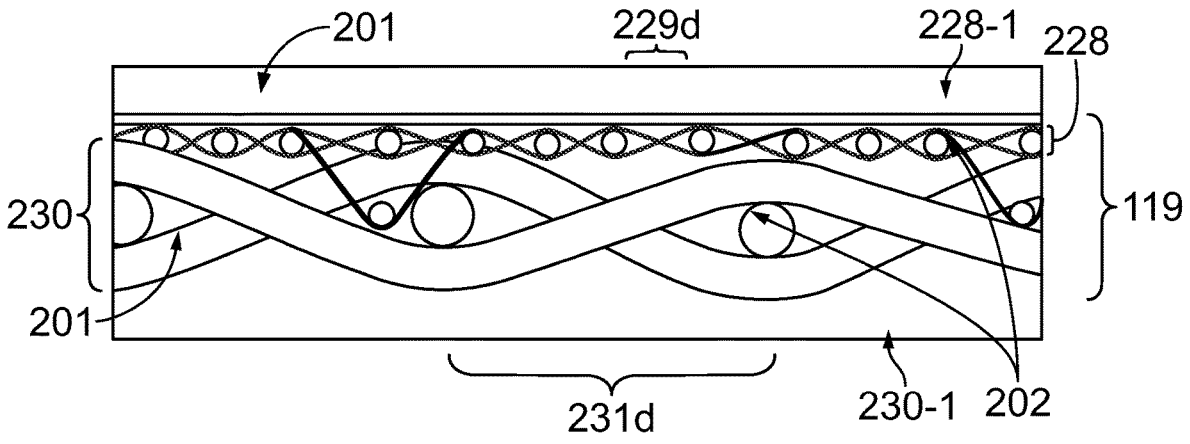
FIG. 4 depicts a cross-section of an exemplary multi-layered flexible member.

In aspects, the flexible member 119 may comprise between two and eight layers 228, 230, for example as shown in exemplary FIG. 4. The layers 228, 230 may or may not be welded and/or glued together. In aspects, the flexible member 119 may comprise at least two layers including an innermost layer (or "reservoir layer") 230 at an inner surface 230-1 and an outermost layer (or "capillary layer") 228 at an outer surface 228-1. The reservoir layer 230 may comprise a low-flow suction roll layer. The capillary layer 228 may comprise a plastic weave fabric. The innermost layer 230 may comprise or consist of inner pores 231 having an inner pore diameter 231*d*, and the outermost layer 228 may comprise or consist of outer pores 229 having an outer pore diameter 229*d*. An effective pore diameter 231*d* of the inner pores 231 of the innermost layer 230 may be greater than an effective pore diameter 229*d* of the outer pores 229 of the outermost layer 228. In aspects, the effective pore diameter 229*d* of the outer pores 229 of the outermost layer 228 may be 1-20 μm. In aspects, the effective pore diameter 229*d* of the outer pores 229 of the outermost layer 228 may be 1-5 μm. Various pore shapes are possible, with particular pore shapes potentially being capable of contributing to enhanced capillary dewatering of the wet web 117. A flexible member 119 comprising at least two layers with differing effective pore diameters may increase cleaning efficiency. Further, a flexible member 119 comprising at least two layers with differing effective pore diameters may alter the water flow resistance through the flexible member 119. It may be expected that placing an additional material with smaller pores on top of the framework 151, 152 would hinder liquid flow into the interior of the framework 151, 152 and would be harder to clean. However, it was unexpectedly found that placement of the flexible member 119 in accordance with the present disclosure about the exterior surface 156 of the framework 151, 152 did not hinder liquid flow and was easier to clean, as compared to a conventional framework.

Cleaning may be performed by a cleaning means 174 such as a shower. Cleaning means 174 may be located within the framework 151, 152 (such as depicted in exemplary FIG. 2A). Alternatively, cleaning means 174 may be located at a location separate from the framework 153 (such as depicted in exemplary FIG. 2B), for example between rolls 123, 125. The cleaning means 174 may be located interior to the flexible member 119, 120 (such as depicted in exemplary FIG. 2B), or exterior to the flexible member (not pictured). In aspects, the framework 151, 152 is cleaned by the cleaning means 174 during each rotation of the roll.

In general, a porosity of the flexible member 119 may be less than a porosity of the apertures in the rigid framework 151, 152. In accordance with aspects of the present disclosure, the flexible member 119 may have an effective pore diameter of 1-20 μm (microns). In aspects, the flexible member 119 may have an effective pore diameter of 1-5 μm. As used herein, the term "porosity" refers to the fractional volume that is not occupied by solid material. The porosity of a material or object (or a portion/region thereof) may be calculated as follows:

$$\varphi = \frac{V_V}{V_T}$$

where φ=porosity, $V_v$=void volume, and $V_T$=total volume.

The effective pore size may be determined using capillary flow porometry. Typically, pores are thought of in terms such as voids, holes or conduits in a porous material. Usually, the pores in natural and manufactured porous materials are not perfectly cylindrical, nor all uniform. Therefore, the effective pore diameter, as disclosed herein, may not equate exactly to measurements of void dimensions obtained by other methods such as microscopy. However, the effective pore diameter provides an accepted means to characterize relative differences in void structure between materials.

The equipment operates by changing the test chamber air pressure in user-specified increments, either by decreasing pressure (increasing pore size) to absorb liquid, or increasing pressure (decreasing pore size) to drain liquid. The liquid volume absorbed at each pressure increment is the cumulative volume for the group of all pores between the preceding pressure setting and the current setting.

In addition to the test materials, a blank condition (no sample between plexiglass plate and Millipore Filter) is run to account for any surface and/or edge effects within the chamber. Any pore volume measured for this blank run is subtracted from the applicable pore grouping of the test sample. This data treatment can be accomplished manually or with the available TRI/Autoporosimeter Data Treatment Software, Release 2000.1.

Figure 3:
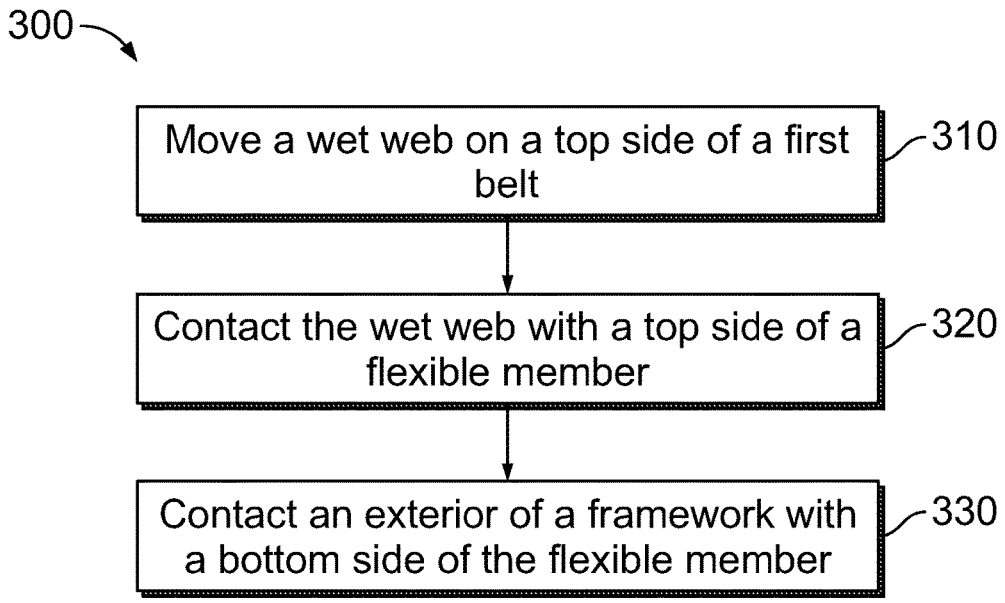
FIG. 3 is a flowchart of an exemplary capillary dewatering process, in accordance with the present disclosure.

Referring now to FIG. 3, in accordance with aspects of the present disclosure, a capillary dewatering process 300 is provided. The capillary dewatering process may comprise moving a wet web on a top side of a first belt at 310, in which the first belt further comprises a bottom side; contacting the wet web with a top side of a flexible member at 320 such that liquid flows from the wet web through a thickness of the flexible member; and contacting an exterior of a framework with a bottom side of the flexible member at 320 such that the liquid flows from the flexible member to an interior portion of the framework, after which the method 300 may conclude. The flexible member may be porous, and the framework may comprise a plurality of apertures. The flexible member may be configured to move independently of the framework.

In accordance with aspects of the present disclosure, the flexible member and the framework are not bonded to each other. In aspects, the framework may be stationary, and the flexible member may be configured to rotate around the framework. In aspects, the wet web and the framework may form a nip through which the flexible member runs. In aspects, the flexible member and/or the framework may rotate at a similar rate as the wet web, in which the framework is or is capable of being stationary.

In accordance with aspects of the present disclosure, the capillary dewatering process 300 may further comprise applying a vacuum to the wet web, in which the vacuum is disposed within the framework. In aspects, the wet web may have a breakthrough pressure, and the vacuum may be applied at a pressure below the breakthrough pressure of the wet web.

In accordance with aspects of the present disclosure, the capillary dewatering process 300 may further comprise cleaning the flexible member at a location separate from the framework. A variety of cleaning techniques and means may be used to clean the flexible member, including using a flooded nip or cleaning boxes, as well as using cleaning water that is distinct from the water removed from the web.

In accordance with aspects of the present disclosure, the capillary dewatering process 300 may further comprise subjecting the wet web to thermal drying, in which after contacting the exterior of the framework with a bottom side of the flexible member but before thermal drying, the wet web has a consistency of greater than 30%. In aspects, the wet web has a consistency of between 30%-55%. In aspects, the wet web has a consistency of between 30%-50%. Consistency may be calculated according to the following formula:

$$\text{Consistency} = \frac{\text{dry fiber weight}}{\text{wet weight}}$$

Consistency is typically expressed in terms of a percentage. The wet weight is equal to the dry fiber weight plus the weight of the water (i.e., the water content) that is not removed by the dewatering process. The dry weight may be measured after conditioning in a conditioned room at a temperature of 23.0° C.±1.0° C. and a relative humidity of 50%±2% for a minimum of 2 hours prior to weighing dry weight using a Mettler Toledo balance model PB3001 or a similar instrument. The wet weight is determined by weighing the wet web following the dewatering process in a sealed and tared container on a Mettler Toledo balance model PB3001, and then the consistency may be determined by comparing the wet weight to the dry weight per the formula above. Alternatively, both wet and dry weight can be measured using an Ohaus® MB45 moisture balance (or an equivalent instrument) set to a drying temperature of 130° C., with moisture determined after the weight changes less than 1 mg in 60 seconds (i.e., A60 hold time). After testing is complete, the fibrous paper sample dry weight is rechecked by drying the paper sample for three drying cycles on an 11.5 inch Adirondack Machine Corp. drum dryer, wherein each drying cycle is done at 230° F. and 0.9 R.P.M., with a residence time of 54 seconds per cycle. Following the three drying cycles, the dried fibrous paper is weighed on a Mettler Toledo balance model PB3001.

In accordance with aspects of the present disclosure, the capillary dewatering process 300 may further comprise pre-wetting the flexible member. The process 300 may comprise pre-wetting both the capillary layer and the reservoir layer of the flexible member.

Testing

Testing is performed to determine the efficiency of dewatering of a prior art 6-layer metal plate framework ("Sample A"), as compared with an exemplary flexible member in accordance with present disclosure comprising an effective pore diameter of 1 μm (as determined using capillary flow porometry) ("Sample B"). Each Sample is 15 inches long. Sample A and Sample B are pre-wetted to saturation. Dry fibrous paper (also 15 inches long) is placed in a conditioned room at a temperature of 23.0° C.±1.0° C. and a relative humidity of 50%±2% for a minimum of 2 hours, then the dry weights of the un-wetted fibrous paper are taken. The un-wetted fibrous paper is then placed on top of the saturated sample. Next, the fibrous paper is wetted with a quantity of water to achieve 23% consistency and then rested for 2 minutes, which is sufficient time for the water to spread throughout the fibrous paper.

To test each sample, the saturated wet sample with the 23% consistency fibrous paper on top is pulled across a vacuum table for four minutes, with the vacuum table having vacuum slots with a slot width of 0.0625 inches, such that the average residence time in the vacuum slot is 1 second, which is enough residence time for water transport. The vacuum of the vacuum table is applied through the vacuum slot at a vacuum pressure of 6 Hg (which is less than the air breakthrough pressure of the capillary layer fabric) to dewater the wetted paper,. After dewatering, the vacuum is turned off and the dewatered paper is weighed in a sealed tared container to determine the wet weight, and thus the percent consistency per formula above. Next, each sample member is cleaned by backflushing water in a flat pan containing 2 liters of deionized water (from reverse osmosis water purification). Another fibrous paper is then wetted, and the dewatering process and backflush cleaning is repeated three more times, using the same sample member. The percent consistency for each repeat of the experiment is show below in TABLE 1.

TABLE 1

| Sample | $1^{st}$ Dewatering | $2^{nd}$ Dewatering | $3^{rd}$ Dewatering | $4^{th}$ Dewatering |
|---|---|---|---|---|
| A | 43.33% | 38.10% | 37.14% | 36.04% |
| B | 45.05% | 47.67% | 47.13% | 47.62% |

As can be seen in Table 1, the dewatering efficiency of the prior art member (Sample A) decreased with each repeat of the dewatering experiment. By contrast, the dewatering efficiency of the exemplary flexible member (Sample B) increased with each repeat of the dewatering experiment. The absolute loss in dewatering performance between the first and fourth dewatering experiment is shown in TABLE 2.

TABLE 2

| Sample | Absolute loss in Dewatering Performance |
|---|---|
| A | 7.30% |
| B | −2.56% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dewatering apparatus comprising:

a framework comprising a plurality of apertures; and a flexible member disposed around an exterior surface of the framework, wherein an inner surface of the flexible member is in contact with at least a portion of the exterior surface of the framework;

wherein the flexible member and the framework are not bonded; and wherein the flexible member comprises two layers including an innermost layer and an outermost layer, wherein an effective pore diameter of the innermost layer is greater than an effective pore diameter of the outermost layer.

2. The dewatering apparatus of claim 1, wherein the dewatering apparatus is a capillary dewatering apparatus.

3. The dewatering apparatus of claim 1, wherein the flexible member has an effective pore diameter of 1-20 microns.

4. The dewatering apparatus of claim 1, wherein the flexible member has an effective pore diameter of 1-5 microns.

5. The dewatering apparatus of claim 1, wherein the flexible member is configured to rotate around the exterior surface of the framework.

6. The dewatering apparatus of claim 1, wherein the flexible member is a woven belt.

7. The dewatering apparatus of claim 1, wherein the framework is at least semi-rigid.

8. The dewatering apparatus of claim 1, wherein the flexible member is an apertured film.

9. The dewatering apparatus of claim 1, wherein the framework comprises a screen.

10. The dewatering apparatus of claim 1, wherein the flexible member comprises between two and eight layers.

11. The dewatering apparatus of claim 1, wherein a length of the flexible member is at least two times larger than an outer perimeter of a contact surface of the framework.

12. The dewatering apparatus of claim 1, wherein the flexible member is fitted over the exterior surface of the framework.

13. The dewatering apparatus of claim 1, wherein the framework comprises a vacuum.

14. The dewatering apparatus of claim 1, wherein the flexible member comprises plastic warps and wefts.

* * * * *